United States Patent [19]

Engmann et al.

[11] 4,292,114

[45] Sep. 29, 1981

[54] APPARATUS FOR COILING WIRE

[75] Inventors: Gunther Engmann; Werner Lepach, both of Schwabach; Heinz Speyerer, Nuremberg, all of Fed. Rep. of Germany

[73] Assignee: Maschinenfabrik Niehoff KG, Schwabach, Fed. Rep. of Germany

[21] Appl. No.: 62,945

[22] Filed: Aug. 2, 1979

[30] Foreign Application Priority Data

Aug. 3, 1978 [DE] Fed. Rep. of Germany ..... 2833955

[51] Int. Cl.[3] ..... B65H 54/00; B65H 67/04

[52] U.S. Cl. ..... 156/447; 83/490; 83/504; 83/909; 219/10.53; 242/18 PW; 242/25 R

[58] Field of Search ..... 242/25 R, 25 A, 16, 242/17, 18 PW, 18 EW, 164, 165; 53/430, 461, 303; 140/71 C, 112; 219/10.53; 156/169, 443, 446, 447, 361; 83/490, 504, 909

[56] References Cited

U.S. PATENT DOCUMENTS

| | | | |
|---|---|---|---|
| 3,441,229 | 4/1969 | Henrich | 242/25 A |
| 3,596,844 | 8/1971 | Engmann | 242/25 A |
| 3,620,482 | 11/1971 | Bravin | 242/25 A |
| 4,098,467 | 7/1978 | Engmann et al. | 242/25 A |
| 4,173,311 | 11/1979 | Lucke | 83/909 |

*Primary Examiner*—Michael W. Ball

[57] ABSTRACT

Method and apparatus for winding wire on a double flanged spool by means of a single spooler wherein the wire is automatically carried from a feed roller toward the spindle by grasping the free end of an endless wire, guiding the grasped end in an orbital path about a spindle, until a portion remote from the wire is grasped by another means adjacent to the spindle and wire is then caused to be cast from the other grasping means over the end flange of the spool and onto the spool itself. Thereafter the wire is wound about the spool after which, the wire is automatically grasped and cut from the spool by the orbital means so as to restart a new cycle of winding.

13 Claims, 10 Drawing Figures

APPARATUS FOR COILING WIRE

BACKGROUND OF THE INVENTION

The present invention relates to a method and an apparatus for initiating and terminating, automatically the winding and coiling of substantially endless cord type material, particularly wire about a two flange spool body wherein the wire is manipulated, with respect to the spool body in such a manner that its feeding, clamping, and tension during the initial phases and during the terminal phases occur automatically.

Apparatus for affecting the feeding of a wire to the spindle are known as single spooler devices. In these devices however it is necessary to intervene manually in the operating cycle at certain points. Such manual intervention is required at the end of spooling to sever the wire from the filled spool body as well as in the initial step of fixing and of tying the wire to the still empty spool body, prior to its coiling. In addition, manual fixing of the wire end of the completely coiled spool is necessary so that the coiled material will not unravel or become damaged during subsequent. transport. Apart from the fact that human operators are absolutely needed for these steps, since these measures must be carried out manually, the cost thereof is greatly enhanced by the fact that the necessary operators must be extraordinarily skilled and speedy, since long interruptions lead to considerable down time while inexperienced handling leading to excessive scrap and waste is extremely costly.

Moreover, a disadvantage of the known devices is quite evident in that they cannot be automatically programmed and controlled so as to continuously operate in successive cycles.

It is the object of the present invention to provide both method and apparatus by which the enumerated disadvantages of the prior art are eliminated and a smooth fully automatic operative cycle can be effected so as to increase production in a more economical manner.

By fully automatic operative cycle it is to be understood that with the aide of known spool changing devices, a plurality of spools can be filled successively without any operator intervention being required, except perhaps for the removal and mounting of the spool.

SUMMARY OF THE PRESENT INVENTION

Accordingly, the present invention provides a method for winding wire by a single spooler on a double flanged spool by means of a single traversing feed roller wherein the wire is automatically carried from the feed roller toward the spindle, thrown over the flange of the spool whereupon it is wound, and then on completion of winding the tail end of the wire is automatically severed and held for the next winding operation.

In particular, the present invention comprises the steps of grasping the free end of an endless wire entrained over a traversing feed roller, guiding the free end in an orbital path about the spindle, until a portion is moved adjacent to the spindle, grasping the wire adjacent the spindle, casting the wire over the end flange of the spool and onto the spool itself. Thereafter the wire is wound about the spool. After winding the wire is again grasped by the orbital guide and simultaneously automatically cut from the spool so as to enable the restart of a new cycle of winding.

Still further in accordance with the present invention apparatus is provided in combination with a spindle adapted to hold a double flanged spool, and having a traversing feed roller, comprising support means orbital about said spindle. A clamping head mounted on the support means operable to hold the leading end of the wire being fed from the feed roller and to carry the same adjacent to the spindle on movement of the support means. Clasping means is located on the spindle to grasp the wire brought into proximity with it to permit further orbiting of the orbital support means located on the orbital support means for thereafter throwing the wire thus grasped by the clasping means over the adjacent flange of the spool so that it may be wound thereon. The orbiting support means being movable after the winding of the spool so that the clamping head may again hold the wire upon completion of the winding. Said clamping head including means for cutting the wire from the wound spool simultaneously with its holding thereof to thereby permit withdrawal of the spool from the spindle while holding the leading end of the wire for the next winding operation.

Full details of the present invention are set forth in the following description and are shown in the accompanying drawings.

BRIEF DESCRIPTION OF THE DRAWINGS

In the accompanying drawings

DESCRIPTION OF THE INVENTION

Before turning to a description of the present invention, it is to be noted that the invention is to be employed on a wire winding machine of a single spool type which is otherwise conventional in nature. That is, the mounting of the spools, the spindles on which they are rotatable, the means for rotating the spindle, and the control systems for such devices are known. Reference, for example, is made to U.S. Pat. Nos. 3,565,357 and 3,620,482, for conventional details of the wire winding machine. The present description will be limited to those aspects of the wire winding machine which are needed to fully understand the present invention.

Figure 2:
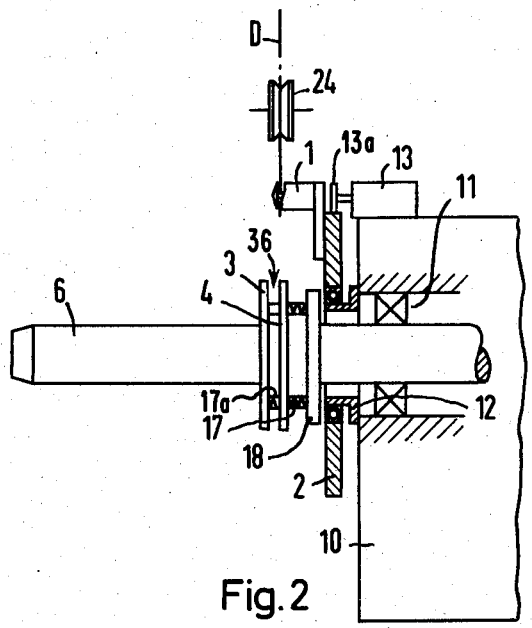
FIG. 2 is a side view of the portion of the winding machine illustrating the present invention in association with the spindle and the traversing feed roller.
Figure 3:
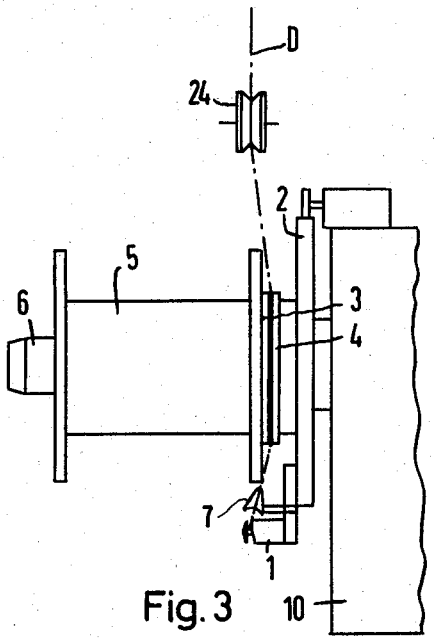
FIG. 3 is an enlarged view of FIG. 2 illustrating the feeding of the wire to a spool, mounted on the spindle.
Figure 4:
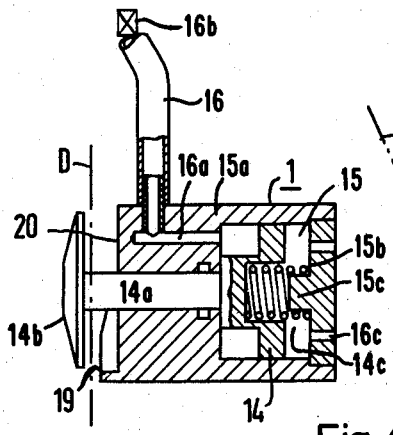
FIG. 4 is a large scale view of the clamping head of the present invention.

Turning first to the apparatus shown in FIGS. 2 through 4, an endless wire D to be wound is fed from a conventional source over a traversing feed roller 24 in conjunction with a rotatable spindle 6 on which a spool 5 is mounted. The spindle is journaled in conventional fashion in a radial bearing 11 mounted on the machine frame 10 to extend cantilevered therefrom so as to easily receive and permit the removal of a spool. The spool 5 is of conventional construction and comprises a cylindrical core having a pair of radially enlarged end flanges. The spindle 6 is driven by suitable gear or belt transmission so as to rotate clockwise as seen in the drawings. The spindle is further provided with a base plate 18 limiting the inward movement of the spool and means for locking and keying the spool in place thereon for conjoint rotation therewith, such as a longitudinal flange, and/or slot, all in conventional manner.

The wire D is fed over the feed roller 24 so that its leading end falls into proximity with a clamping head, generally depicted by the numeral 1. The clamping head 1 is mounted on the front face of a disc 2, (although the disc may be replaced by an elongated arm) which is freely mounted concentrally about the spindle on a radial bearing 12 so as to be moved round about the spindle, in either direction. Mounted on the frame 10 is a small electric motor 13 having an output shaft on the end of which is a small friction wheel 13*a* engaging the peripheral edge of the disc 2. The motor 13 is reversible and is suitably controlled so as to rotate the disc clockwise or counterclockwise by the imposition of an electric current of corresponding polarity as seen in the drawings. This causes clamping head 1 to be carried in orbital fashion about the spindle spaced at a predetermined radial distance therefrom. Instead of the electric motor 13, a pressing air-motor with a reversible valve may be used.

As seen in FIG. 4, the clamping head 1 comprises a piston 14 slidably mounted within a chamber 15 formed in a cylindrical body 15*a*. Extending from the piston axially through the body is a rod 14*a* having a button-like head 14*b* mounted at its end, in a plane perpendicular to the rod. The frontal face of the body 15*a* facing the button member is shaped in a partially tubular fashion to provide a knifelike peripheral segmental edge 19 extending axially outward and about a portion of the circumference thereof and a flat segment 20 planar with the frontal face. The diameter of the button 14*b* is substantially equal to the inner diameter of the circumferential knifelike segment 19 so as to form with it a counter surface for the cutting of the wire, while a flat countersurface with the button 14*b* is provided by the portion 20 so as to hold the wire, if placed therebetween.

The piston 14 and piston rod 14*a* are normally biased by a compression spring 15*b* seated on a boss 15*c* at the rear end of the body, at one end and extending at its other end into a bore 14*c* formed in the piston. The piston thus is normally urged to push the buttonhead 14*b* outwardly from the frontal face of the body 15*a* but is movable inwardly against the spring force to close the head against the frontal face. To effect this closing movement of the piston the chamber is connected to a source of air or hydraulic fluid media under pressure via a duct 16 formed in the body opposite to the front face of the piston. The duct is connected to the source of pressurized media via a suitable conduit 16*a* and is provided with a two way valve control means 16*b* whereby the pressurized media may be forced to flow in and out in a controlled or predetermined manner. The rear portion of the body is provided with bleedholes 16*c* communicating with the chamber 15 so as to permit the piston to move under effect of the pressurized media and/or the compression spring freely within the chamber.

Mounted concentrically about the spindle 6, adjacent to the base plate 18 so as to rotate conjointly with the spindle are a pair of annular clasping discs 3 and 4 defining a gap 36 therebetween. The inner disc 4 is biased outwardly from the base plate by three first helical springs 17, while the outer disc is biased outwardly from the inner disc by three second helical springs 17*a*. The discs 3 and 4 are preferably locked together by the springs, the ends of which are connected to the discs and to the base plate so as to effect the conjoint rotation of the spindle. Discs may be keyed to the spindle by a groove and tongue or otherwise secured thereto to effect the conjoint rotation while permitting axial movement of the disc relative to the spindle. The discs 3 and 4 are biased by their springs into the open position as seen in FIG. 2 wherein the gap 36 between the discs 3 and 4 lies in the plane of the incoming wire D. The distance clamping discs 3 and 4, are pressed outwardly by the springs 17 and 17*a*, is adjustable by screws (not shown), compensate a different thickness of the spool flanges. It is intended that the gap 36 between them, when in the open position lies always in the plane of the incoming wire D.

It is possible to form a clasping arrangement between a single disc or even the base plate 18 and the flange of the spool directly, eliminating the need for the pair of spring load discs. The clasping member may also be external of the spindle.

Figure 10:
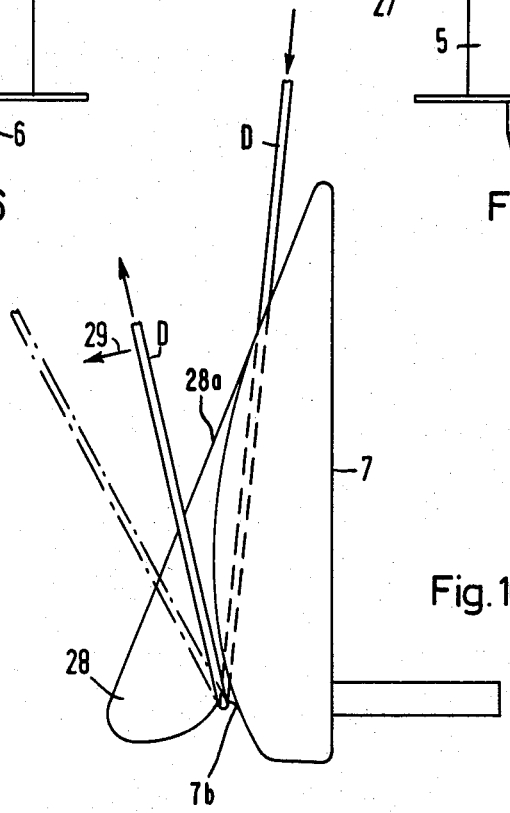
FIG. 10 is a perspective view on a larger scale of the formation of the throwover means of the present invention.

Mounted at the edge of the orbital disc 2 in proximity but slightly to the rear of the clamping head 1 is a guide member 7. The guide member as seen more clearly in FIG. 10 is wedge-shaped with a cusp 7*b*. The guide member is mounted on the orbital disc so that when the clamp head is positioned in the uppermost position as seen in FIG. 2 it does not interfere with the wire D. However, it will be seen more clearly the guide member 7 is mounted so that once the wire D is engaged between the clamping discs 3 and 4, further orbiting of the clamping head causes the wire to engage first the cusp 7*b* and as it moves further, the wire moves along the chamfered edge 28 of the guide, in the direction of the arrow 29 as seen in FIG. 10 where it slowly moves over the adjacent flange of the spool onto the body of the spool itself.

The guide member may take other forms such as a hook, roller finger or the like provided the lateral movement of the wire is effected on movement of the orbital support.

Figure 1:
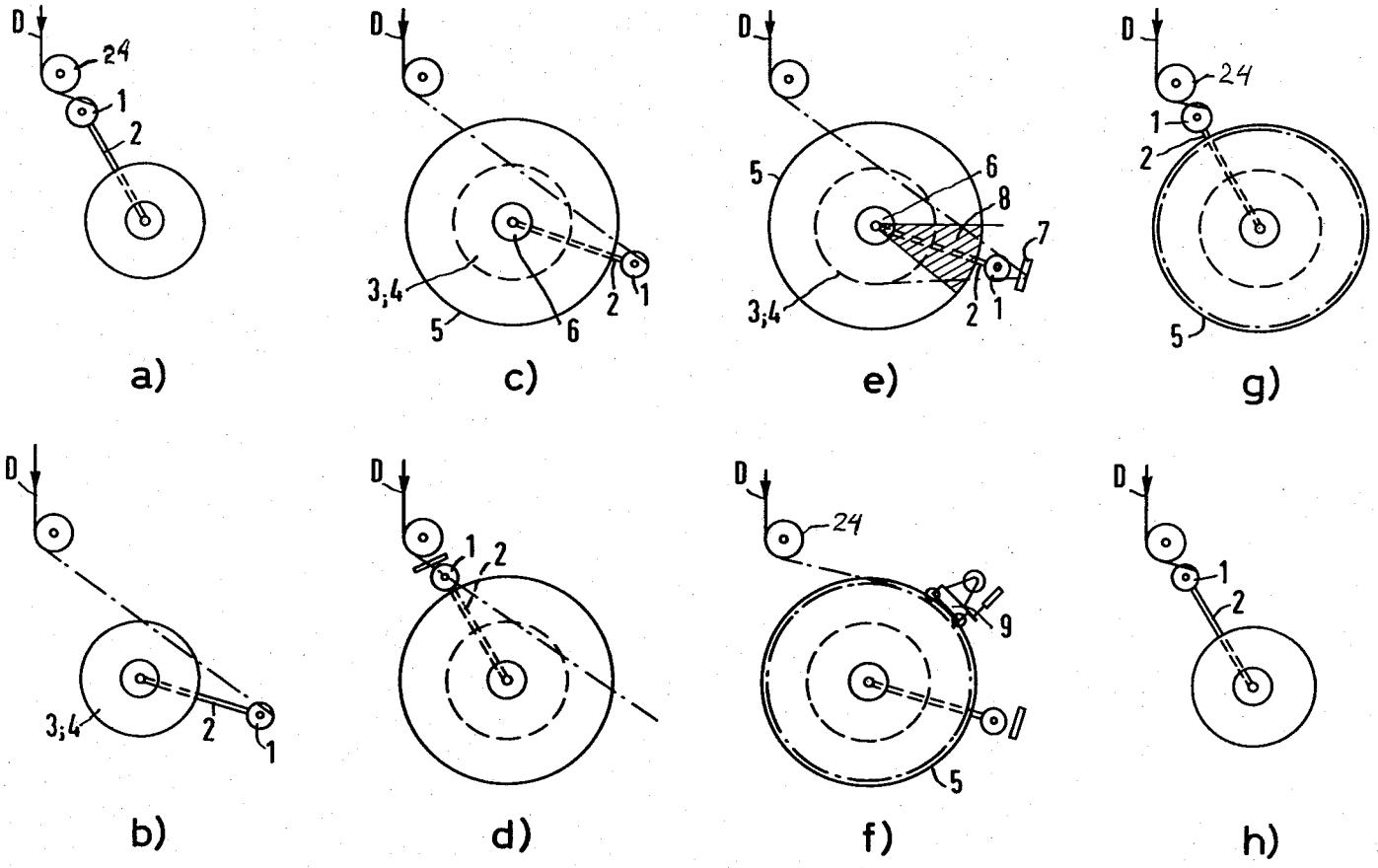
FIGS. 1*a* through 1*h* diagrammatically illustrate the successive steps of the method of the present invention.

The method by which the present invention operates is schematically illustrated in the successive frames of FIG. 1. In the first step (1*a*) the wire D is fed from an endless source over the feed roller 24 until its end comes to rest in the open gap of the clamping head 1. (FIGS. 2 and 4). At this time, the clamping head is closed by a burst of pressurized media into the chamber 15 and the wire is held tightly by its end. The wire is held between the button 14*b* and the planar frontal segment 20 of the front face of the clamping body. If it should happen that the leading edge wire is somewhat longer than necessary to effect proper clamping, the excess will dangle over the knife portion 19 and will be cut off immediately upon closing of the button.

Figure 7:
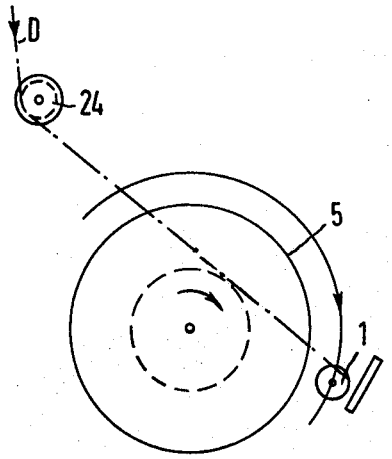
FIG. 7 is a view of the apparatus of FIG. 6 in end view.
Figure 9:
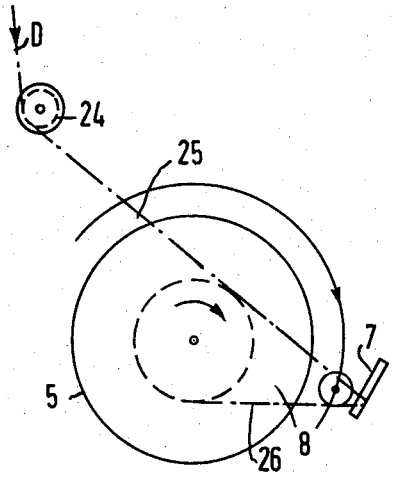
FIG. 9 is a corresponding front view of FIG. 8.
Figure 6:
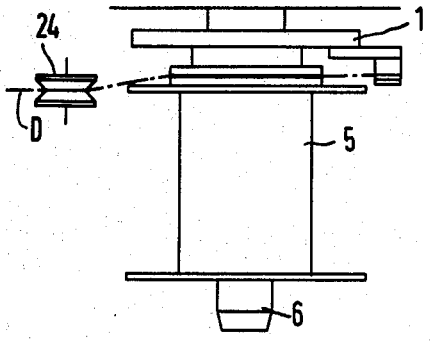
FIG. 6 is a plan view similar to FIG. 3 showing the clamped wire between the two clamping discs.
Figure 8:
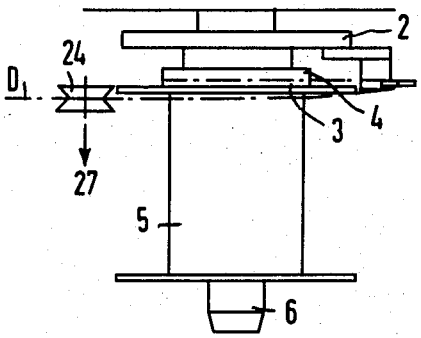
FIG. 8 is a view similar to FIG. 6 showing the throwover means for guiding the wire from the proximity of the spindle onto the spool core.

Once the clamping head 1 secures the wire D the motor 13 is actuated and the clamping head is caused to orbit about the spindle in the clockwise direction (FIG. 1*b*) until the wire, because of the arrangement of the orbiting clamping head, the feed roller 24 and the spindle, comes into proximity with the spindle, passing into the open gap 36 between the clamping discs 3 and 4 mounted about the spindle, which gap 36 it will be remembered lies in the vertical plane of the fed wire. The motor 13 is then stopped and the wire is held in this position. Whereupon the spool is mounted on the spindle and is moved axially along the spindle all the way inward and then locked into place. The movement of the spool against the clasping discs 3 and 4 causes the clasping discs to close, as seen in FIG. 3, against the base plate 18. Upon closing of the clasping discs the wire is held firmly in place in the gap 36 therebetween (1*c*) (See also FIG. 6 & 7). At this moment the clasping head 1 is opened releasing the end of the wire, to be held solely by the clasping discs 3 and 4. The motor 13 is again started and clamping head continues its orbiting clockwise movement about the spindle. Guide 7 passes the wire along the chamfered edge 28 of the guide. Since however, the wire, as seen in FIG. 3 is now clasped between the clasping discs 3 and 4 which now lie out of the plane of the incoming wire, the wire is contacted by the chamfered edge of the guide member 7 (1*d*). As the clamping head and spindle repeat their clockwise movement to a point about the circumference of the spindle indicated by the shaded sector 8 in FIG. 1*e* a loop (see also FIGS. 8 and 9) is formed in the wire extending from the end grasped between the clasping member 3 and 4 and the end being fed from the feed roller 24, by its contact in the cusp 7*b*. As the wire rides over the guide 17 it is caused by reaction with the roller 24 to pass over the inner flange of the spool 5 and upon further rotation of the orbital clamping head in the clockwise direction the wire rides over the share 28 and comes to rest on the bottom of the spool core. Whereupon, rotation of the spindle is effected as by a suitable relay mechanism to the device motor and the wire is wound upon the spool. Winding of course, progresses due to the fact that the leading end is held between the discs 3 and 4. The winding of the wire on the spool itself locks the free initial end of the wire firmly in place.

The orbital clamping head 1 is returned to its initial position as seen in FIG. 1 and its drive is stopped so that it remains in this position during the continued winding of the spool. The wire is then conventionally fed to the rotating spool 5 and the wire wound thereon in usual helical fashion by traversal of the feed roller 24 in the direction of the arrow 27 seen in FIG. 8. The spindle is continued in its rotation until a complete coil is wound approximately the diameter of the flange of the spool itself. The spindle is provided with suitable limit switches, and brake means which stop the spindle, on completion of winding a fixed predetermined angular position wherein the wire placed over the flange upon start up for the next cycle lies outside the set-down of the spool body.

Figure 5:
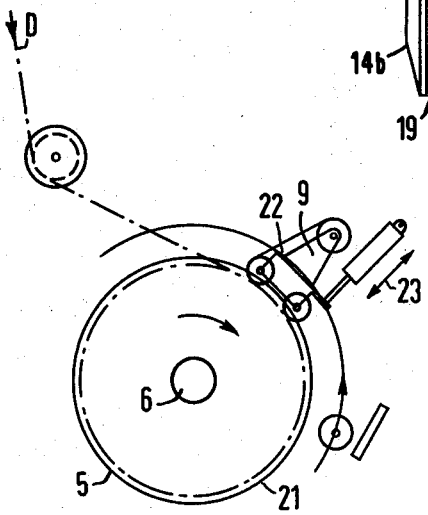
FIG. 5 is a diagramatic view of the fully wound spool body with a final turn adhering device for securing the end of the coil.

Upon completion of the coil, which can be sensed by a tactile sensor on the surface thereof, measurement of the length of wire fed or other suitable means the spindle 6 is stopped and a suitable end fixing device, generally illustrated by the numeral 9 is activated for movement radially inward against the wire FIG. 1*e* and FIG. 5. The fixing device 9 for the fully wound spool may be a gluing apparatus which supplies an adhesive tape which is applied to the last several turns of the wire. The gluing device is conventional in nature and is mounted to move radially relative to the spindle and is moveable by means of a pneumatic or hydraulic piston toward and away from the spool as seen by the double arrow 23 in FIG. 5. Instead of an adhesive tape, a plastic foil may be used or a high frequency welding apparatus may be used which by application of a high frequency surge can adhere and affix the wire together. Spot welding of the adjacent coil turns may also be effected. In any event, the fixing of the terminal end of the coil is facilitated by the fact that the end of the wire is still being held by the roller 24.

Figure 4A:
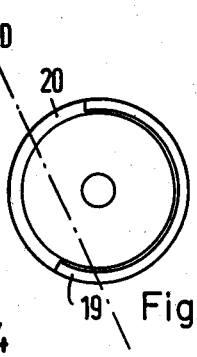
FIG. 4*a* is a frontal view of the clamping head showing the holding and cutting edges thereof.

Upon the adhesion of the trailing end of the wire to orbiting disc 2 is again actuated but orbited in the reverse (i.e. counterclockwise) direction FIG. 1*f*, as seen also in FIG. 1*g*. At this point the fixing device is removed, and the feed roller 24 placed back into the plane of the incoming wire. Thus the reversing orbiting clamping head 1 which is in its open position, engages the wire at the point, seen in FIG. 1*g*, from the reverse direction and the wire lodges between the clamp button 14*b* and the frontal face of the body 15*a* in the manner shown in FIG. 4*a*. At such time, a portion of the wire lies in the planar sector 20 while a portion of the wire lies over the sector in which the cutting knife 19 is arranged. Actuation of the clamping piston thereupon causes the clamping button 14*b* to clamp the wire firmly in its place at sector 20 while simultaneously cutting it free from the spool. The orbiting clamping head 1 is then in the position of FIG. 1*g* while holding the now free end of the wire firmly in its grasp. The clamp may thereafter make a small turn clockwise relative to the spool into a predetermined starting position wherein it is assured that the free end of the wire coiled about the spindle will not interfere with the removal of the spool from the spindle and so that any pinching or bending of the wire end is avoided and that the entire spool can be removed undamaged for further processing. Thereafter the apparatus is stopped, the spool removed, ending the cycle of operation. This situation seen in the cycle can be restarted and another spool wound with the coil of wire.

The inter-relationship of the orbiting clamping head, the clamping action, the movement of the spool, the application of the cutting element, and all the steps shown in FIG. 1 can be made automatically by the application of an automatic control system. Such a control system will include control means for the operation of the spindle motor itself, operation of the motor driving the orbital clamping head, and the means for feeding the wire. The pneumatic or hydraulic means for operating the clamping head 1, and the adhering means 9 can be fed from a source by suitable control electro-magnetic control valves, operated by one or more relays receiving signals from the coil sensors, start buttons, a feed sensor on roller 24 and the like. These means are well within the scope of those skilled in the art, now that the arrangement of the apparatus and its mode of operation is described herein.

Various modifications, changes and embodiments have been shown herein. It is believed that other such changes and modifications will be known to those skilled in the art. Accordingly, it is intended that the present invention will not be limited by the disclosure, but only by the appended claims.

In FIG. A there is shown the sequence of the several steps in the wire winding machine of the present invention; the actual production of and winding of the spool is illustrated by the dotted lines.

In FIG. B there is shown the control components for operating the present machine and circuit diagram for operating the present machine. The individual components are conventional and their arrangement clearly illustrated.

What is claimed is:

1. In a single spooler for winding wire on a flanged spool having one rotatable spindle for mounting said spool and means for traversingly feeding the wire thereto, apparatus for automatically carrying the lead end of the wire to the spool and casting the wire over the flange, comprising support means mounted to orbit about said spindle, said support means having mounted thereon a clamping head operable to fixedly secure said wire thereto, and a guide member offset in the orbital path from said clamping wire for causing the wire to shift laterally, and clasping means mounted adjacent said spindle to hold said wire, said clamping head being operable on movement of said support means to lead said secured wire from said feed means into proximity with said spindle adjacent said spool whereupon said clasping means is operable to secure the same, and on further movement of said support means the guide member is operable to cast the wire over the flange of said spool onto the core thereof.

2. The apparatus according to claim 1 wherein said clamping means includes knife means arranged in a selected portion thereof, said support means being movable on completion of the winding of said spool to cause said clamping head to engage the trailing portion of said wire to sever said wire from the traversing feed means and clamp the severed edge.

3. The apparatus according to claim 2 including means for securing the trailing end of said wire to the completed spool.

4. The apparatus according to claim 3 wherein said means for securing the trailing end of said wire comprises a tape applicator mounted spaced from said spindle into contact with said wire on completion of said coil.

5. The apparatus according to claim 3 wherein said means for securing the trailing edge of said wire comprises welding mechanism moveable radially into contact with said wire on completion of said coil.

6. The apparatus according to claims 3, 4 or 5 wherein said means for securing said wire is mounted on a pistoncylinder device actuated by a mechanical hydraulic or pneumatic means.

7. The apparatus according to claims 1, 2 or 3 wherein said clasping means, comprise a pair of discs concentrically arranged about said spindle, means for resiliently biasing said discs axially away from each other to provide a gap for said wire, said discs being closed to clasp said wire on mounting of the spool on said spindle.

8. The apparatus according to claim 7 wherein said discs are removeably secured to said spindle.

9. The apparatus according to claim 2 wherein said clamping head comprises a body having a frontal face and a member moveable toward and away from said face, said face being formed with a tubular sector defining a cutting edge along a portion of its peripheral edge, the remaining edge portion being planar with the frontal face, said cutting edge cooperating with the moveable member to effect cutting of the wire, the remaining edge portion cooperating with the moveable member to hold the wire.

10. The apparatus according to claim 9 wherein said moveable member is secured to a piston extending into a cylinder formed in said body, and said clamping head includes means for reciprocating said piston in response to a predetermined signal.

11. The apparatus according to claim 1 wherein said guide means comprises a guide-member having surface adapted to engage and slidingly move said wire laterally.

12. The apparatus according to claim 1 including means for arresting the spindle, upon completion of the winding at a predetermined angular position.

13. The apparatus according to claim 1, wherein said guide means comprises a blade-like member, having a curved plate surface on which said wire slides laterally.

* * * * *